US007861480B2

(12) United States Patent
Wendelburg et al.

(10) Patent No.: US 7,861,480 B2
(45) Date of Patent: Jan. 4, 2011

(54) ROOF SUBFRAME SYSTEM

(75) Inventors: Mark Wendelburg, Houston, TX (US); Tim A. Lane, Concord Township, OH (US)

(73) Assignee: Top-Hat Framing System, LLC, Painesville, OH (US)

( * ) Notice: Subject to any disclaimer, the term of this patent is extended or adjusted under 35 U.S.C. 154(b) by 399 days.

(21) Appl. No.: 11/969,013

(22) Filed: Jan. 3, 2008

(65) Prior Publication Data

US 2008/0163573 A1 Jul. 10, 2008

Related U.S. Application Data

(60) Provisional application No. 60/878,559, filed on Jan. 4, 2007.

(51) Int. Cl.
*E04D 3/24* (2006.01)
*E04D 3/36* (2006.01)
*E04B 7/00* (2006.01)

(52) U.S. Cl. ..... 52/483.1; 52/471; 52/474; 52/478; 52/479; 52/506.04; 52/506.06; 52/573.1; 52/783.11; 52/783.17; 52/798.1; 52/800.12

(58) Field of Classification Search ..... 52/334–336, 52/327, 410, 478–480, 747.1, DIG. 15, 404.1, 52/406, 488, 627–628, 656–664, 666, 582, 52/394–395, 459–471, 476, 481.1, 775, 777, 52/779–780, 506.03, 506.04, 506.06, 782.11, 52/783.19, 800.12, 843, 713, 473.1, 508, 52/512; 428/136–137, 119–120, 183–186, 428/180, 139

See application file for complete search history.

(56) References Cited

U.S. PATENT DOCUMENTS

| | | | | |
|---|---|---|---|---|
| 3,574,103 | A * | 4/1971 | Latkin | 428/72 |
| 3,759,006 | A * | 9/1973 | Tamboise | 52/406.1 |
| 4,034,135 | A * | 7/1977 | Passmore | 428/184 |
| 4,894,967 | A * | 1/1990 | Morton | 52/334 |

(Continued)

FOREIGN PATENT DOCUMENTS

GB 2100771 A * 1/1983

OTHER PUBLICATIONS

"Prior Art Roofing System with 'Z-shaped' Subframes and Deflection Limiters." (2 pages of drawings—Exhibits 1 and 2).

(Continued)

*Primary Examiner*—Jeanette E. Chapman
(74) *Attorney, Agent, or Firm*—Conley Rose, P.C.

(57) ABSTRACT

A subframe for retrofitting an existing roof with a new roof is disclosed. In some embodiments, the subframe comprises a base, a first and second longitudinal flanges, a first wall extending between the base and the first longitudinal flange, a second wall spaced apart from the first wall and extending between the base and the second longitudinal flange, and a traversely-oriented punch out passing through the base, the first wall and the second wall. The punch out is configured to receive a rib of the existing roof. Once installed on the existing roof and coupled to the new roof, the subframe and new roof form an enclosed, self-supporting structure with increased structural capacity and stability in comparison to conventional retrofitted roof systems.

17 Claims, 5 Drawing Sheets

U.S. PATENT DOCUMENTS

| | | | | | |
|---|---|---|---|---|---|
| 4,914,886 | A | * | 4/1990 | Eriksson et al. | 52/537 |
| 5,367,848 | A | * | 11/1994 | McConnohie | 52/336 |
| 5,600,971 | A | * | 2/1997 | Suk | 52/713 |
| 5,737,892 | A | | 4/1998 | Greenberg | |
| 5,743,063 | A | * | 4/1998 | Boozer | 52/713 |
| 5,911,663 | A | * | 6/1999 | Eidson | 52/520 |
| 6,141,932 | A | * | 11/2000 | Tarrant | 52/514 |
| 6,176,065 | B1 | * | 1/2001 | Honda | 52/783.18 |
| 7,174,686 | B1 | * | 2/2007 | Legband | 52/471 |
| 7,779,590 | B2 | * | 8/2010 | Hsu et al. | 52/334 |

OTHER PUBLICATIONS

"Roof Hugger Presents The 'World Champion' Attachment for Retro Fitting Roofs-Walls-Facias," Brochure, Jan. 2000, pp. 1-12.
"Retro Fit With The Sub-purlins That Set The Attachment Standards In Reroofing!," Brochure, Summer 2001, pp. 1-12.
"The Hugger Advantage, Roof Hugger, For Retro-fitting Roofs The Right Way!," Brochure, Spring 2007, pp. 1-12.
"How's Your Retro-Fitness?," Advertisement, 1 Page.
"Roof Hugger, Erection Instructions," Brochure, pp. 1-2.
Correspondence dated Nov. 6, 2008 regarding patentability of the present application, from Smith & Hopen, an intellectual property law firm, pp. 1-49.

* cited by examiner

Fig. 1
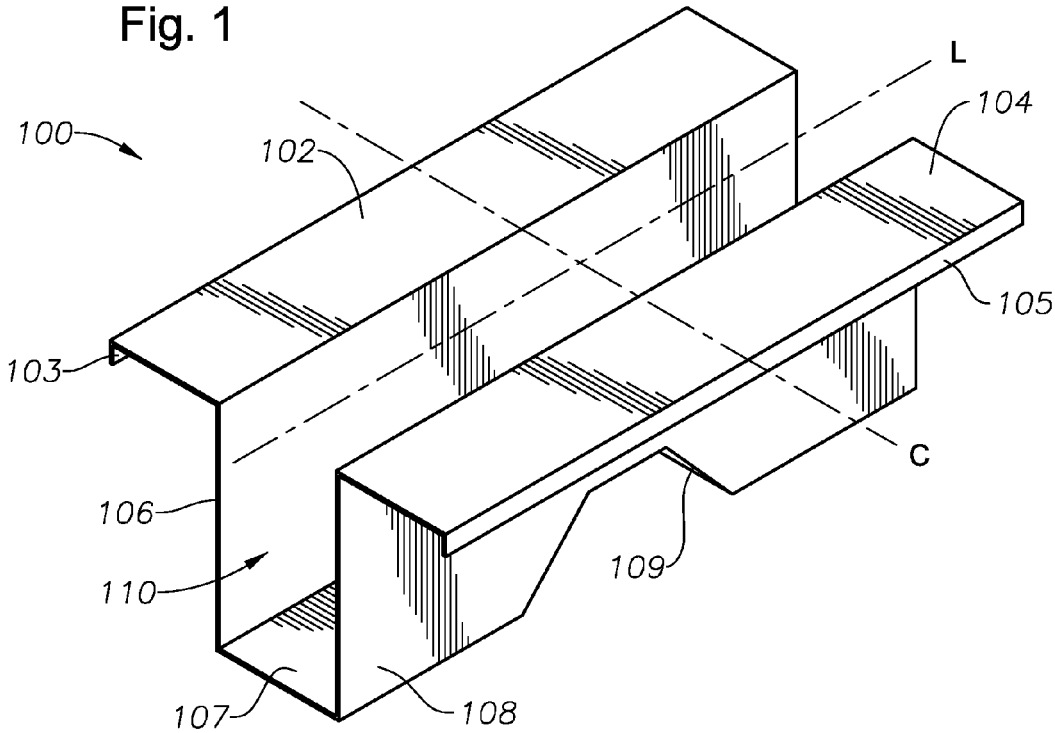
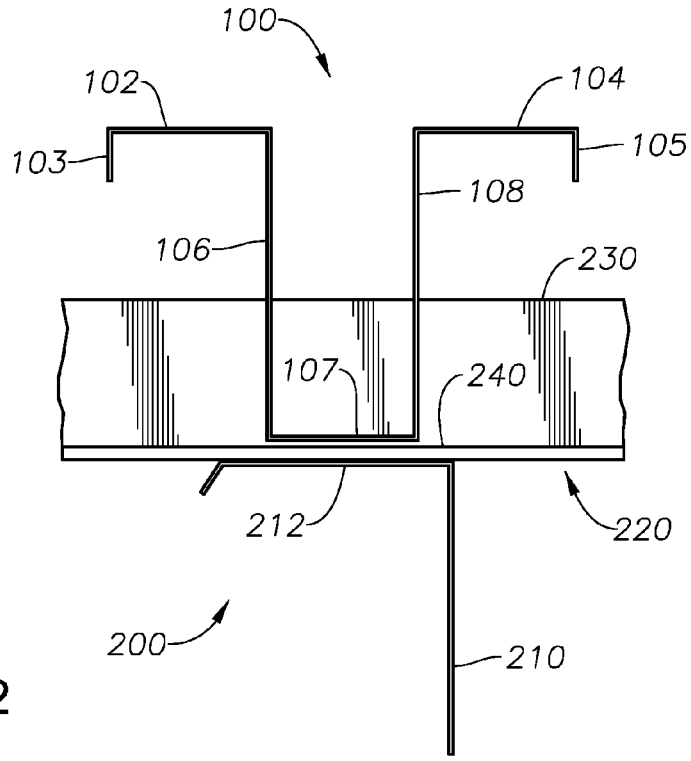
Fig. 2

Fig. 6
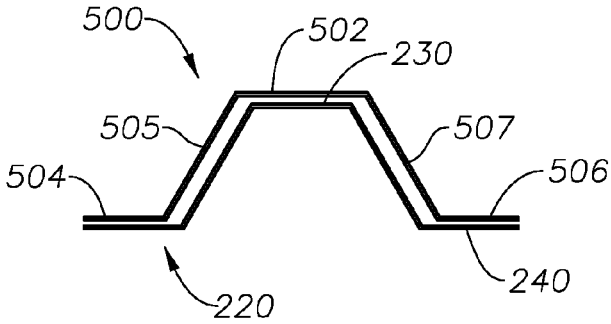
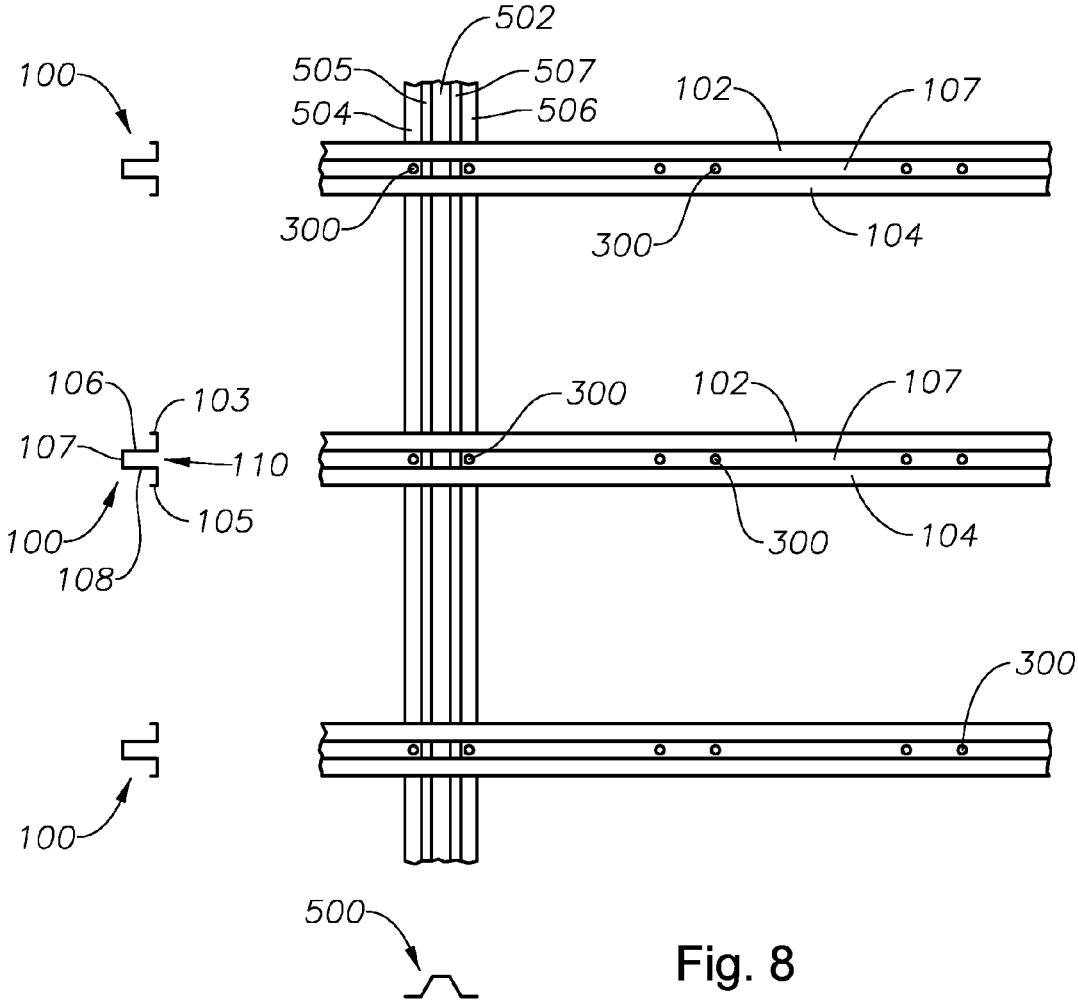
Fig. 8

ROOF SUBFRAME SYSTEM

CROSS-REFERENCE TO RELATED APPLICATIONS

The present application claims the benefit of, and incorporates by reference, provisional application Ser. No. 60/878,559, filed Jan. 4, 2007, and entitled "Roof Runner Subframe System."

STATEMENT REGARDING FEDERALLY SPONSORED RESEARCH OR DEVELOPMENT

Not Applicable.

BACKGROUND

1. Field of Art

The present invention relates generally to a system and method for retrofitting a roof envelope of a building. More particularly, the present invention relates to a system and method for installing a new metal roof over an existing metal roof. Still more particularly, the present invention relates to a roll formed metal roof subframe system which enables installation of a span of new metal roof decking panels over a span of existing metal roof decking panels.

2. Description of Related Art

Metal roof decking is a building envelope system made from metal decking panels or sections. Each metal decking panel is secured by fasteners to the support structure (typically made of steel) of the building on which the roof is located Metal roof decking is inherently strong and lightweight, and thus offers several advantages over other types of roofing (i.e., asphalt shingles, etc.), such as increased durability, energy efficiency, resistance to weather damage, and ease of installation, as well as being comparatively economical and having low maintenance requirements. Also, metal roof decking may be designed for use with pitched, flat, or arched construction, and may be applied to nearly all types of buildings.

Standing seam metal roofs are also popular on virtually all types of buildings due to their weather-tightness, durability, and flexible design. Additionally, standing seam metal roofs are more energy efficient and cost effective than many non-metal counterparts, and have an additional desired characteristic of allowing for thermal movement within the roof system.

Metal roof decking products have a number of shapes, materials, and aesthetic variations that can be used in constructing roof decking for buildings. One common type of metal roof decking is known as a fluted, or ribbed, roof decking. Ribbed metal roof decking includes a plurality of ribbed metal roof decking panels, each panel characterized by a sequence of alternating upper and lower surfaces that extend the length of the panel. The upper surfaces, or ribs, are found substantially in an upper plane, and are substantially parallel to each other. Likewise, the lower surfaces, or valleys, are found substantially in a lower plane, one that is generally parallel to and spaced vertically apart from the upper plane. The upper and lower surfaces are connected by a series of vertical or sloped walls which also extend the length of the panel. The upper, lower and vertical or sloped walls define flutes, or channels. When installed to form metal roof decking, the ribbed metal roof decking panels typically overlap one another, and span over and are secured by fasteners to underlying support structures, sometimes referred to as purlins. In this configuration, the ribbed metal roof decking panels are connected to form a continuous span to create the roof envelope of a building.

For various reasons, the metal roof decking of a building, in part or whole, may be in need of repair, replacement, upgrade, or a general retrofit. Due to the lightweight qualities of some metal roof decking, an existing roof may be retrofit by installing a system of subframes over the original roof decking, and securing the new roof decking to the subframe system. The use of subframe systems in this manner provides additional support and points of attachment for the new metal roof decking panels. In some instances, however, conventional subframe systems cannot be used to transition from an older roof configuration in need of retrofit to a new metal roof decking that complies with new construction practices and roof uplift requirements. Additionally, conventional subframe systems may not provide the necessary strength over a long roof span, and may require inefficient production and time-consuming installation processes.

Accordingly, there remains a need for new and improved metal roof subframing systems for use in the retrofit of metal roof decking that address certain of the foregoing difficulties.

SUMMARY OF THE DISCLOSED EMBODIMENTS

Certain of the shortcomings noted above are addressed, at least in part, by a subframe. In some embodiments, the subframe includes an elongate base portion, a first wall extending between the base portion and a first longitudinal flange, a second wall spaced apart from the first wall and extending between the base and a second longitudinal flange, and a punch out passing traversely the base, the first wall and the second wall.

Some roof system embodiments include a first roof panel, a second roof panel and a subframe therebetween. The first roof panel is supported by a support member and has at least one raised rib. The subframe positioned between the first roof panel and the second roof panel. The punch out of the subframe matingly receives the raised rib of the first roof panel, with the upper surface of the subframe engaging and supporting the second roof panel.

Some embodiments of a subframing system include a deflection limiter of a given length configured to overlay a first rib of a first roof. The deflection limiter includes a first foot extending from a first angled wall, a second foot extending from a second angled wall, and a rib wall coupled between the first angled wall and the second angled wall. The subframing system also includes a first subframe member generally disposed normal to the length of the deflection limiter and configured to couple to the deflection limiter.

Some roof system embodiments include a first roof on a building. The first roof has a first roof panel having a plurality of parallel ribs and supported by a support member. The roof system embodiments also include a second roof panel, a deflection limiter overlaying a first rib of the first roof panel and extending in a direction parallel to the ribs, and a first subframe member engaging the deflection member. A first punch out of the first subframe member receives the rib of the deflection limiter and a second punch out of the first subframe member receives the rib of the first roof panel.

Some methods include positioning a first subframe member over a rib of a first roof, coupling the first subframe member to a support member of the first roof, overlaying a second roof on the first subframe member, and coupling the first subframe member to the second roof. These methods may also include positioning a deflection limiter over a rib of the first roof, positioning a second subframe over the deflection limiter and substantially at a right angle to the deflector limiter, coupling the second subframe to the deflection limiter and the deflection limiter to the support member, overlaying the second roof on the second subframe, and coupling the second subframe to the second roof. The first subframe is substantially identical to the second subframe.

Thus, the embodiments disclosed herein comprise a combination of features and characteristics that are directed to overcoming various shortcomings of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will be made to the accompanying drawings, wherein:

FIG. 1 is a perspective view of an embodiment of a roof decking subframe;

FIG. 2 is a cross-sectional view of the roof decking subframe of FIG. 1 installed on an existing roof;

FIG. 6 is a cross-sectional view of an embodiment of a deflection limiter installed over an existing roof panel;

FIG. 8 is a top view of a portion of the subframe system of FIG. 7; and

DETAILED DESCRIPTION OF THE PREFERRED EMBODIMENTS

Figure 3:
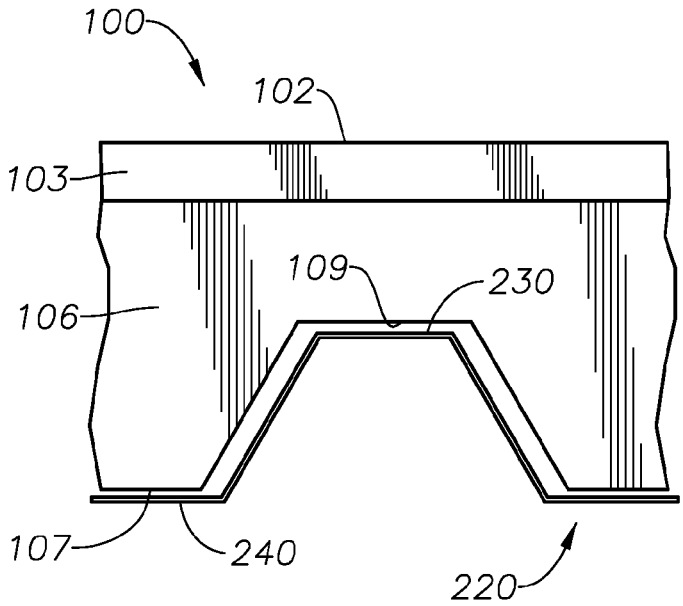
FIG. 3 is another view of the roof decking subframe shown in FIG. 2.

In the description that follows, like parts are marked throughout the specification and drawings with the same reference numerals, respectively. The drawing figures are not necessarily to scale. Certain features may be shown exaggerated in scale or in somewhat schematic form, and some details of conventional elements may not be shown in the interest of clarity and conciseness. The present invention is susceptible to embodiments of different forms. There are shown in the drawings, and herein will be described in detail, certain embodiments of, the present invention, with the understanding that the present disclosure is to be considered an exemplification of the principles of the invention, and is not intended to limit the invention to these embodiments illustrated and described herein. It is to be fully recognized that the different teachings of the embodiments discussed below may be employed separately or in any suitable combination to produce desired results.

Referring now to FIG. 1, a perspective view of an embodiment of a roof deciding subframe 100 is depicted. In this exemplary embodiment, subframe 100 is an elongate support member that may be manufactured from a variety of metals having a wide range of thicknesses, including but not limited to, 14 or 16 gauge steel. In end view or in cross-section, subframe 100 may be described as generally hat-shaped. The "hat shape" of subframe 100 refers to the shape of its cross-section, which, when inverted from its orientation shown in FIG. 1, appears like a hat with a brim. Subframe 100 includes a base portion 107 that is spaced apart from an upper section with opposing horizontal surfaces that comprises first longitudinal flange 102 and second longitudinal flange 104. First and second longitudinal flanges 102, 104 are generally coplanar and oriented in a generally horizontal plane that is parallel to the plane of base 107. Flanges 102, 104 are substantially symmetric about the longitudinal axis "L" of subframe 100. A first wall 106 and a second wall 108 extend vertically downward from a first edge of first longitudinal flange 102 and a first edge of second longitudinal flange 104, respectively. Although first and second walls 106, 108 are normal to first and second longitudinal flanges 102, 104 in this exemplary embodiment, first and second walls 106, 108 may extend from first and second longitudinal flanges 102, 104 in other angular orientations. As shown in FIG. 1, some embodiments of subframe 100 include a first lip 103 and a second lip 105 extending vertically downward from a second edge of first longitudinal flange 102 and a second edge of second longitudinal flange 104, respectively.

First and second walls 106, 108 are coupled to and interconnected by base 107. As shown, base 107 is the lowermost portion of subframe 100 and extends horizontally between respective ends of first and second walls 106, 108. Channel 10 is formed by first wall 106, base 107, and second wall 108. A void, or punch out 109, is created in subframe 100. Punch out 109 extends along a central axis "C" that is generally perpendicular to the longitudinal axis "L" of subframe 100. Punch out 109 passes through corresponding sections of first wall 106, second wall 108, and base 107. When subframe 100 is installed over an existing roof panel, punch out 109 is configured to matingly receive or fit over a rib of the existing roof panel. In the embodiment shown in FIG. 1, punch out 109 has a generally trapezoidal shape when viewed in a direction perpendicular to the longitudinal axis "L". Punch out 109 may have other shapes, however. The trapezoidal shape is one selected to generally correspond to or match the shape of raised ribs on many conventional metal roof panels. While subframe 100 is depicted as having a single punch out 109, subframe 100 typically will include a plurality of punch outs 109 positioned at intervals along We length of subframe 100, thereby allowing subframe 100 to mate with a number of raised ribs of the existing roof panels so as to accommodate any existing roof panel rib pattern.

Subframe 100 may be created by a rollformed manufacturing process. With this process, the length of subframe 100 can easily be controlled and tailored to the desired span of existing metal roof decking to be retrofit. Moreover, with rollformed manufacturing, any length of subframe 100 is obtainable, allowing subframe 100 to be used on any span of existing roof decking.

FIGS. 2 and 3 depict a single subframe 100 member installed over an existing roof system 200. In practice, multiple subframes 100 would be installed over an existing roof system 200 in order to support new roof panels. The existing roof system 200 includes a plurality of purlin supports 210 and overlapping metal roof deck sections 220. Each section 220 includes a plurality of ribs 230, with each rib 230 positioned between and extending from two adjacent valleys 240.

Each purlin support 210 includes top flange 212, configured to receive fasteners flat couple subframe member 100 and section 220 to purlin 210.

Figure 4:
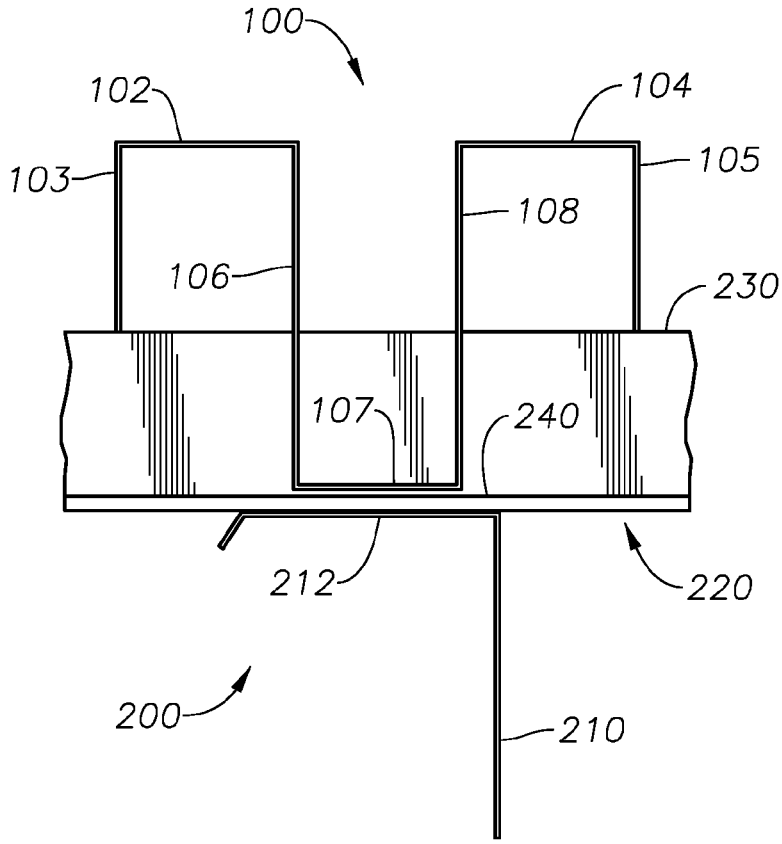
FIG. 4 is a cross-sectional view of another embodiment of a roof decking subframe.

To couple subframe 100 to the existing roof system 200, subframe 100 is positioned over a section 220 in alignment with a purlin support 210 such that longitudinal flanges 102, 104 extend generally perpendicular to the direction of ribs 230 of existing roof system 200. When aligned with purlin support 210, base 107 of subframe 100 rests on valley 240 of existing roof section 220 with punch out 109 positioned over a rib 230, Fasteners 300 are then inserted through base 107 and valley 240 and into purlin support 210 at intervals along the length of subframe 100 to couple subframe 100 to top flange 212 of purlin support 210. In some embodiments, the respective heights of subframe 100 and ribs 230 may be chosen such that first and second lips 103, 105 extend so as to rest in contact with an upper surface of ribs 230, as shown in FIG. 4.

Figure 5:
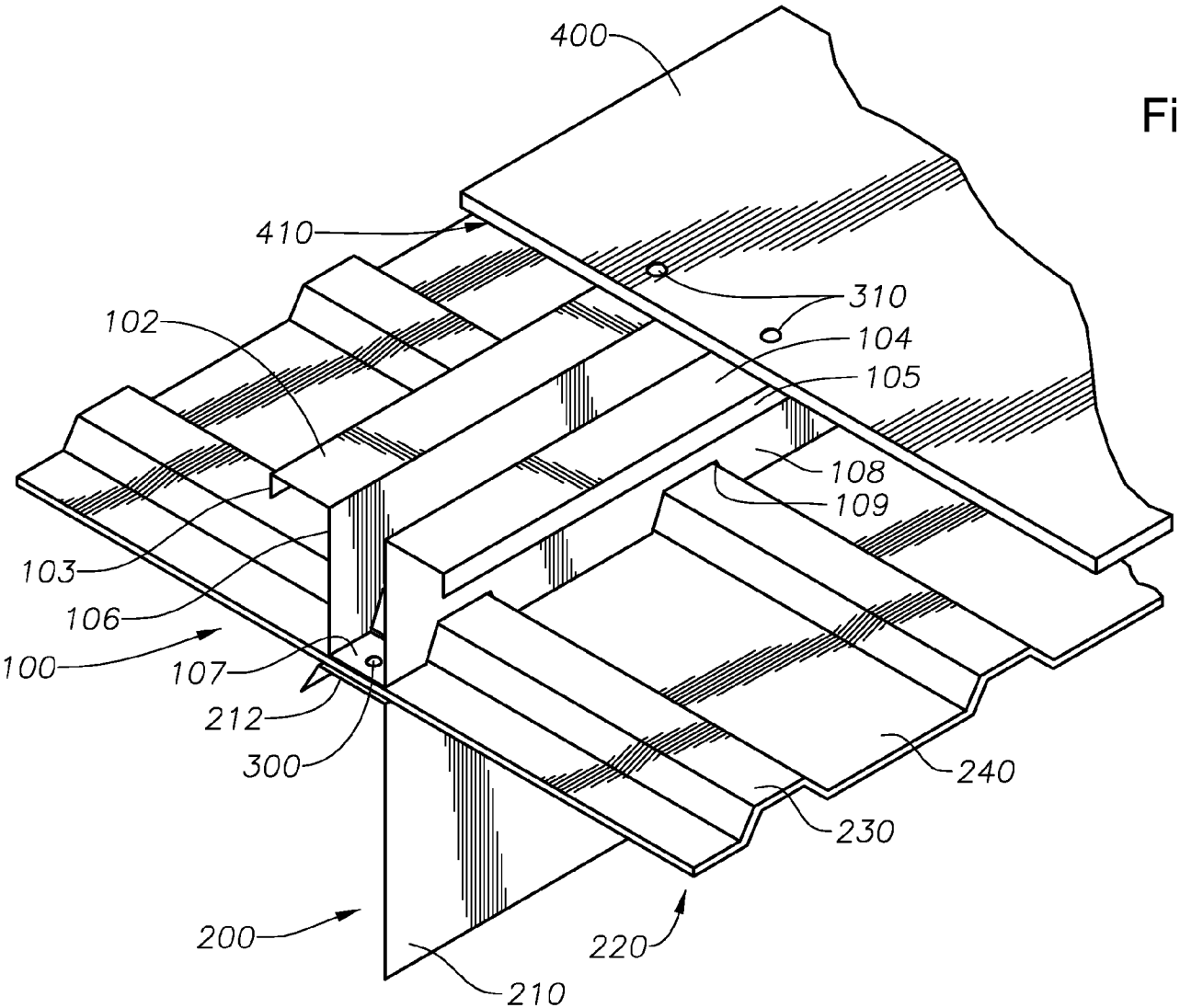
FIG. 5 is a perspective view of the existing roof of FIG. 2 retrofitted with an embodiment of a subframe system including the subframe of FIG. 2 and a new roof.

After subframe 100 is secured to a purlin support 210 of an existing roof system 200, retrofit of the roof may proceed by installing new roof decking panels or sections over subframe members 100 and above the existing roof system 200, Referring to FIG. 5, a new roof deck section 400 is positioned over subframe 100 such that a bottom surface 410 of new roof deck section 400 engages the first and second longitudinal flanges 102, 104 of a subframe 100. New section 400 is then coupled to subframe 100 by a plurality of fasteners 310 engaging first and second longitudinal flanges 102, 104 and section 400. Fasteners 310 may be threaded fasteners, such as screws. Alternatively, in the case of a standing seam roof, new section 400 may be installed on subframe 100 using a standing seam clips and clip screws of the type known in the art.

When subframe 100 is coupled to new roof deck section 400, channel 110 of subframe 100 is enclosed by first wall 106, base 107, and second wall 108 of subframe 100 and by new roof deck section 400. Thus, the coupling of new roof deck section 400 to subframe 100 creates an enclosed, self-supporting tubular structure that has greater structural capacity and stability in comparison to other structures which are not self-supporting, such as a subframe member having only a single support wall coupled between the old roof and a new roof deck section 400. As used herein, "self-supporting" is used to describe a subframe support member that, in end view or cross-section, has a channel or trough that, once closed by attachment to new roof sections 400, forms a closed conduit or tubular structure, regardless of the cross-sectional shape of the conduit. Moreover, in embodiments, including those depicted by FIG. 4, in which first and second tabs 103, 105 of subframe 100 engage the existing roof system 200, tabs 103, 105 provide lateral support of the new roof section 400.

The self-supporting structure formed by subframe 100 and new roof deck section 400 allows subframe 100, specifically first and second walls 106, 108 and base 107, to better support the weight of new roof deck section 400, as well as other loads applied to section 400, such as the weight of accumulated snow. Moreover, torque applied to new roof sections 400, by, for example, wind loads, is reacted in both first and second walls 106, 108 of subframe 100 and (in the embodiments depicted by FIG. 4) further resisted by the reaction of first and second tabs 103, 105 with existing roof 200. These features provide greater structural stability for the new roof section 400, in comparison to that provided by a subframing system having subframes with only a single support wall. Also, the structure formed by subframe 100 and new roof deck section 400 allows shorter spans to be engineered into existing roof system 200 without disturbing existing roof system 200, including purlin supports 210. As such, subframe 100 can be engineered to accommodate new building and roofing code design loads without re-working existing roof system 200 or purlin supports 210. In other words, subframe 100 and new roof sections 400 can be added to many existing roof systems 200 to substantially strengthen the combined roof system without the need of moving, adding to, or otherwise disturbing the existing purlin supports 210.

Buildings located in some geographical regions, such as coastal areas, experience high wind loads. For this reason, buildings in these regions may be required to satisfy more stringent design standards. This may necessitate roofs constructed prior to the adoption of the stringent design standards to be retrofit in compliance with the newer standards. For instance, in metal roofs constructed using one common construction practice, the main supporting structural members are typically placed at 5 feet on center throughout the building roof span. New constructions practices and uplift requirements, particularly in geographic regions experiencing high wind loads, such as coastal regions, may now require much closer spacing than 5 feet over some or all of the roof envelope. To enable compliance with new construction practices and uplift requirements, the retrofit of an existing roof system 200, as described above, may be supplemented with the installation of a plurality of structural members that are positioned between the existing roof panels and the subframe members 100. These structural members, referred to herein as deflection limiters, are positioned over existing roof system 200 such that the combination of the deflection limiters and subframes 100 forms a support structure for a new roof system 400 that satisfies the spacing requirement dictated by the new construction practices and uplift requirements.

In more detail and referring now to FIG. 6, an exemplary embodiment of a deflection limiter 500 installed over a rib 230 of an existing roof system 200 is shown. Deflection limiter 500 has a shape and a profile, as viewed in cross section and in end view, that is similar to one period, or one rib 230, of an existing ribbed roof section 220. Each deflection limiter 500 includes an upper rib 502 positioned between a first foot 504 and second foot 506. Upper rib 502 is connected to first foot 504 by first sloped or angled section 505 and to second foot 506 by second sloped or angled section 507, respectively.

A new roof system 400 may be retrofit to existing roof system 200 using a support structure formed by a plurality of deflection limiters 500 and subframes 100 such that the support structure conforms to new construction practices and satisfies new uplift requirements. In some embodiments, retrofit of new roof system 400 to existing roof system 200 proceeds as follows.

Figure 7:
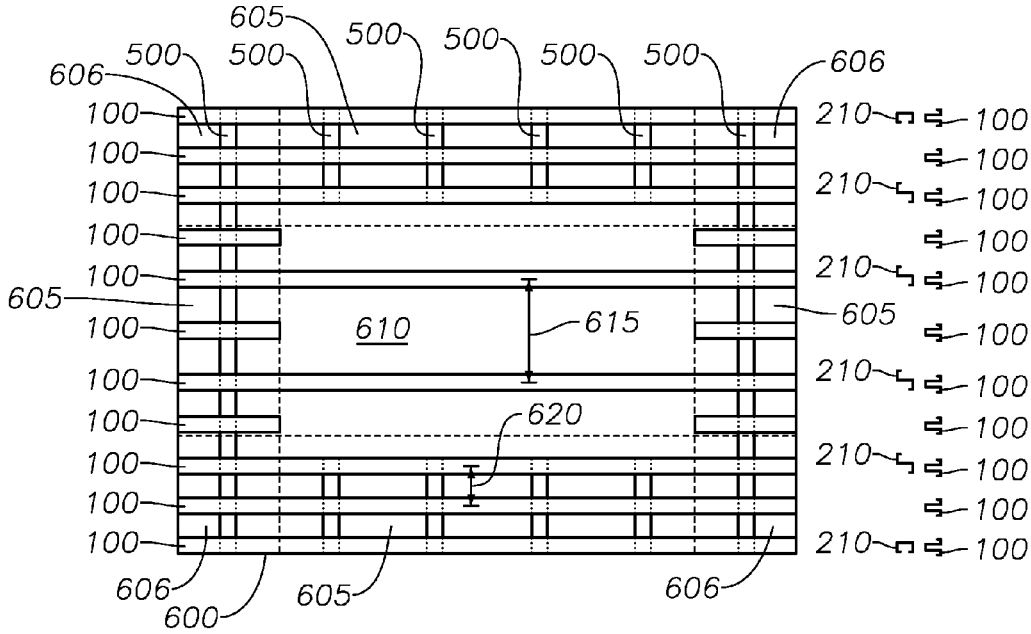
FIG. 7 is a schematic illustrating the roof enclosure of an existing roof with a subframe system having a plurality of the deflection limiters of FIG. 6 and subframes of FIG. 1 installed in the edge zone.

The roof envelope 600 of existing roof system 200 is conventionally known to be divided into two zones, an edge zone 605 and a field zone 610, as shown in FIG. 7. The edge zone 605 is a fraction of the roof envelope and extends along the perimeter of the roof envelope, while the field zone 610 is disposed within and is circumscribed by the edge zone. The edge zone 605 may be subdivided to include four corner zones 606 as illustrated. Typically, the corner zones 606 experience the highest uplift forces, such as from wind. The support structure of existing roof system 200 may have a spacing 615 typical of conventional construction practices, for example, 5 foot on center throughout the roof envelope 600. However, new construction practices and uplift requirements may dictate that the support structure for a new roof system 400 have a smaller spacing 620 within, for example, the edge zone 605. To form a support structure meeting the new spacing requirement, a plurality of deflection limiters 500 and subframes 100 are positioned within the edge zone 605, while only subframes 100 are positioned within the field zone 610, the field zone 610 not requiring the supplemental support provided by deflector limiters 500.

First, a plurality of subframes 100 are installed within field zone 610. Each subframe 100 is installed using methodology previously described with reference to FIGS. 2 and 3. Each subframe 100 is positioned over a section 220 of existing roof system 200 within field zone 610 and in alignment with a purlin support 210 supporting section 220. Subframe 100 is positioned such that longitudinal flanges 102, 104 extend generally perpendicular to the direction of ribs 230 of existing roof system 200. When aligned with purlin support 210, base 107 of subframe 100 rests on valley 240 of section 220 with punch out 109 positioned over a rib 230, as best shown in and previously described with reference to FIGS. 2 and 3. Fasteners 300 are then inserted through base 107 and valley 240 and into purlin support 210 at intervals along the length of subframe 100 to couple subframe 100 to top flange 212 of purlin support 210.

Next, a plurality of deflection limiters 500 and subframes 100 are installed within edge zone 605. Each deflection limiter 500 is positioned over a rib 230 of existing roof section 220 within edge zone 605, as shown in FIG. 7, and coupled to purlins 210. The size and configuration of deflection limiters 500 may be varied to accommodate ribs 230 of existing roof system 200 and to meet the uplift requirements.

A subframe 100 is then positioned across at least some deflection limiters 500 such that subframe 100 is normal to deflection limiters 500, and such that punch out 109 of subframe 100 receives deflection limiters 500, as shown in FIGS. 7 and 8. Additional subframes 100 are similarly positioned such that the spacing between adjacent subframes 100 satisfies the reduced spacing requirement 620, as may be dictated by new construction practices mid uplift requirements or as otherwise desired. After subframes 100 are positioned in this manner, subframes 100 are coupled to deflection limiters 500 and also to purlins 210 as previously described. Finally, new roof system 400 is positioned on subframes 100 and coupled thereto.

Figure 9:
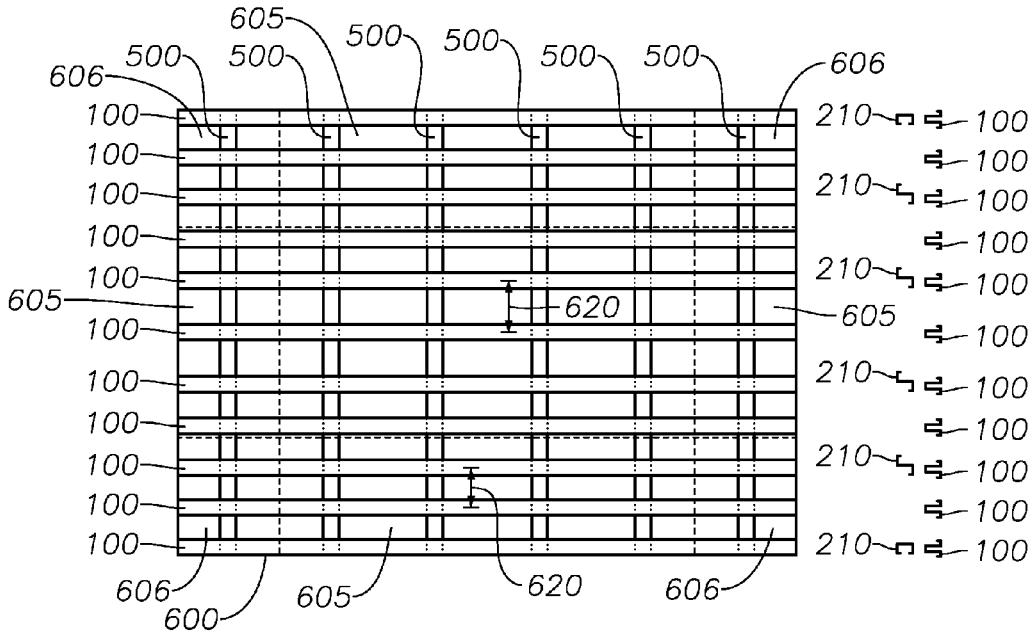
FIG. 9 is a schematic illustrating the roof enclosure of an existing roof with a subframe system having a plurality of deflection limiters of FIG. 6 and subframes of FIG. 1 installed in the edge and field zones.

Alternatively, it may be desirable, or new construction practices and uplift requirements may dictate, that the support structure of new roof system 400 has smaller spacing 620 in regions in addition to edge zone 605, for example, throughout the entire roof envelope 600. Therefore, in other embodiments, a plurality of deflection limiters 500 and subframes 100 are installed, as described above, within both edge zone 605 and field zone 610. In this manner, an enhanced support structure meeting the new spacing requirement 620, as shown in FIG. 9, is created. New roof system 400 is then installed over subframes 100, as previously described.

The systems and methods for a subframing system having a plurality of subframes 100 disclosed herein enable retrofit of an existing roof with new roof. Due to the nature of its design, the subframing system is, in many instances, independent of the existing roof configuration, and thus may accommodate a large number of existing roof configurations. The subframing systems described herein also offer increased structural capacity and stability over that of certain conventional subframing systems. Where new construction practices and uplift requirements necessitate a new roof having a support structure with spacing less than that of roofs built using conventional construction practices, the subframing system may be supplemented using a plurality of deflection limiters 500 and subframes 100. The deflection limiters 500 may be positioned only within certain regions of a roof envelope, such as within the edge zone, or throughout the roof envelope, depending on the uplift requirements, to further enhance the structural capacity and stability of the new roof.

While preferred embodiments have been shown and described, modifications thereof can be made by one skilled in the art without departing from the scope or teaching herein. The embodiments described herein are exemplary only and are not limiting. It will be appreciated that many other modifications and improvements to the disclosed embodiments may be made without departing from the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A roof system comprising:

a first roof panel supported by a support member and having at least one raised rib;

a second roof panel; and a subframe positioned between the first roof panel and the second roof panel, the subframe comprising:

an elongate base;

a first wall extending between the base and a first longitudinal flange;

a second wall spaced apart from the first wall and extending between the base and a second longitudinal flange; and a punch out passing through the base, the first wall and the second wall;

wherein the punch out receives the raised rib of the first roof panel.

2. The roof system of claim 1, wherein the base, the first wall, the second wall and the new roof panel form a self-supporting structure.

3. The roof system of claim 1, wherein the subframe is disposed on said first roof panel such that the rib extends in a direction generally perpendicular to the first longitudinal flange.

4. The roof system of claim 1, wherein the subframe is coupled to the support member.

5. The roof system of claim 4, wherein the base and the first and second walls form an open trough.

6. The roof system of claim 1, wherein the second roof panel is coupled to the subframe.

7. The roof system of claim 1, wherein the first longitudinal flange and the second longitudinal flange engage the second roof panel.

8. The roof system of claim 1, wherein the subframe further comprises a first tab extending from the first longitudinal flange and a second tab extending from the second longitudinal flange and wherein the first tab and the second tab engage the first roof panel.

9. A roof system comprising:

a first roof on a building, the first roof comprising a first roof panel having a plurality of parallel ribs and supported by a support member;

a second roof panel;

a deflection limiter overlaying a first rib of the first roof panel and extending in a direction parallel to the ribs, the deflection limiter comprising:

a first foot extending from a first angled wall;

a second foot extending from a second angled wall; and a rib wall coupled between the first angled wall and the second angled wall; and a first subframe member engaging the deflection member, the first subframe member comprising:

an elongate base;

a first wall extending between the base and a first longitudinal flange;

a second wall spaced apart from the first wall and extending between the base and a second longitudinal flange; and a plurality of punch outs passing through the base, the first wall and the second wall;

wherein a first punch out of the first subframe member receives the rib of the deflection limiter and a second punch out of the first subframe member receives a second rib of the first roof panel.

10. The roof system of claim 9, wherein the deflection limiter and the first subframe are coupled to the support member of the first roof, and the first subframe is coupled to the deflection limiter and the second roof panel.

11. The roof system of claim 9, wherein the first roof has a field zone and an edge zone surrounding the field zone, and wherein the deflection limiter is positioned in the edge zone.

12. The roof system of claim 11, further comprising a second subframe member substantially identical to the first subframe, positioned within the field zone, and overlaying a rib of the first roof panel, wherein the second subframe member is coupled between the support member of the first roof panel and the second roof panel.

13. The roof system of claim 9, wherein the first roof has a field zone and an edge zone surrounding the field zone, wherein field zone is free of deflection limiters.

14. A roof system comprising:

a roof panel having a first rib and a second rib spaced apart from the first rib, wherein the ribs are connected by a planar base extending therebetween; and a subframe positioned over the roof panel, the subframe comprising:

an elongate base;

a first wall extending between the subframe base and a first longitudinal flange;

a second wall spaced apart from the first wall and extending between the subframe base and a second longitudinal flange;

a first punch out passing through the subframe base, the first wall, and the second wall; and a second punch out passing through the subframe base, the first wall, and the second wall and spaced apart from the first punch out;

wherein the first punch out receives the first rib and the second punch out receives the second rib with the subframe base supported by the roof panel base.

15. The roof system of claim 14, wherein the subframe is disposed on the roof panel such that the subframe base extends in a direction generally perpendicular to the ribs.

16. The roof system of claim 14, wherein the subframe base and the first and second walls form an open channel.

17. The roof system of claim 14, further comprising a second roof panel coupled to the subframe.

* * * * *